US006651984B1

(12) United States Patent
Luken

(10) Patent No.: US 6,651,984 B1
(45) Date of Patent: Nov. 25, 2003

(54) CARDS AND METHOD FOR PLAYING A MATCHING CARD GAME

(76) Inventor: Jennifer Luken, 321 Summerwood Dr., Watertown, SD (US) 57201-0374

( * ) Notice: Subject to any disclaimer, the term of this patent is extended or adjusted under 35 U.S.C. 154(b) by 0 days.

(21) Appl. No.: 10/147,018

(22) Filed: May 16, 2002

(51) Int. Cl.[7] ..... A63F 1/00

(52) U.S. Cl. ..... 273/292; 273/302; 273/304; 273/306; 273/308; 273/303

(58) Field of Search ..... 273/292, 299, 273/302, 304, 306, 308, 293, 303; 463/13

(56) References Cited

U.S. PATENT DOCUMENTS

| | | | | | |
|---|---|---|---|---|---|
| 1,215,657 | A | * | 2/1917 | Hicks | 273/304 |
| 4,428,582 | A | * | 1/1984 | Smith | 273/296 |
| 4,588,193 | A | * | 5/1986 | Winston | 273/304 |
| 5,374,067 | A | * | 12/1994 | Jones | 273/292 |
| 5,380,012 | A | * | 1/1995 | Jones et al. | 273/292 |
| 5,409,237 | A | * | 4/1995 | Marcley et al. | 273/299 |
| 5,417,432 | A | * | 5/1995 | Dwyer | 273/299 |
| 5,601,488 | A | * | 2/1997 | Kadlic | 463/13 |
| 5,690,336 | A | * | 11/1997 | Oliver | 273/302 |
| 5,727,788 | A | * | 3/1998 | Davis | 273/299 |
| 5,810,361 | A | * | 9/1998 | Kadlic | 273/292 |
| 5,816,576 | A | * | 10/1998 | Aramapakul et al. | 273/292 |
| 5,853,325 | A | * | 12/1998 | Kadlic | 463/13 |
| 5,863,043 | A | * | 1/1999 | Bitner | 273/299 |
| 5,887,873 | A | * | 3/1999 | Freeman | 273/303 |
| 6,234,483 | B1 | | 5/2001 | Bucan | |
| 6,247,697 | B1 | * | 6/2001 | Jewett | 273/292 |
| 6,325,374 | B1 | * | 12/2001 | Burger et al. | 273/271 |

OTHER PUBLICATIONS

U.S. 2003/0008697 A1—J. A. Hartl– Jan. 9, 2003—Combination Wagering Game.*

U.S.2001/0042962 A1—J. F. Simmons—Nov. 22, 2001—System For Providing Entertaining And Enhancing Human Relationships.*

Walter B. Gibson–Hoyle's Modern Encyclopedia of Card Games—1974—Doubleday—pp. 291–296.*

Scarne, J., Chapter entitled "Rummy Games", *Scarne's Encyclopedia of Card Games*, pp. 56–85 (2001).

Mattel® UNO® instructions and information brochure, 2 pgs. (copyright 1999).

* cited by examiner

*Primary Examiner*—Benjamin H. Layno
*Assistant Examiner*—D Collins
(74) *Attorney, Agent, or Firm*—Merchant & Gould P.C.

(57) ABSTRACT

A deck of cards and a method of playing a card game with the deck are disclosed. The deck of cards includes 15 distinct 3-card sets of cards with matching indicia and 7 wild cards with matching indicia. The matching indicia may include representations of people, animals, birds, objects or symbols, or intangible concepts like ideas or services. The game is played by matching a three-card set, which can include wild cards, and by laying matching cards against other players' three-card matches to accumulate points until a player runs out of cards. Although the game can be played for recreational purposes, the game may also be played for educational, training or promotional purposes.

17 Claims, 3 Drawing Sheets

CARDS AND METHOD FOR PLAYING A MATCHING CARD GAME

TECHNICAL FIELD

The present cards and method relate generally to a card game suitable for players of most age groups. More specifically, this invention relates to a matching card game that requires the participants to match cards with identical indicia.

BACKGROUND OF THE INVENTION

Matching card games are popular forms of entertainment. One of the most popular matching card games is the Rummy family of card games.

The object of all Rummy games is to form matched sets, groups and sequences called melds or lays. These melds or lays, when deducted from a player's hand, serve to bring the value of the unmatched cards to a lower total than the unmatched cards of all other players. A player may also meld or lay an entire specified hand of cards in matched sets, which is called Rummy.

A matched set may be either a sequence of three or more cards in the same suit for example, four, five, and six of spades (in games where the player's hand is comprised of ten or fewer cards, it is possible to meld all the cards in the hand in a single sequence); or three or four of a kind, for example, the queen of clubs, queen of diamonds, queen of hearts, and queen of spades.

Traditionally, Rummy card games utilize one or more standard decks of 52 playing cards, from ace to king in four suits. Unless otherwise stipulated, the ace is the lowest-ranking card, having a value of 1. The face cards (king, queen, and jack) are valued at 10 points each. All other cards have their numerical face value. The suits have no value.

Tonk is another popular variation on the Rummy family of card games that also uses a standard 52 card deck. As with Rummy, the object of Tonk is to complete spreads or melds with cards of the same rank (i.e. all kings) or cards of the same suit in sequence. A player may also hit (lay off) a card in his hand against a spread or meld of another player's hand. For example, player 1 spreads a three-card match of kings. Player 2 has the remaining king. When it is player 2's turn, he may hit player 1's meld of three kings with his king. When this happens, player 1 who was hit must wait at least one round before he can go out by either getting rid of his remaining cards by making spreads or by hitting other player's spreads.

Another popular matching card game is UNO®. Unlike the Rummy games, UNO® uses a proprietary set of playing cards. To play UNO®, each player is dealt 7 cards with the remaining ones placed face down to form a draw pile. The top card of the draw pile is turned over to begin a discard pile. The first player has to match the card in the discard pile either by number, color or word. For example, if the card is a red 7, player must throw down a red card or any color 7. Alternately, a player may throw down a Wild Card. If the player does not have a matching card, he must pick a card from the draw pile, which he can play if it forms a match. Otherwise play moves to the next person. When a player has one card left, the player must yell "UNO" (meaning one). Failure to do this results in the player having to pick two cards from the draw pile if the other players notice the player's mistake. When a player is out of cards, he gets points for cards left in the opponent's hands as follows:

All cards through 9=Face value

Draw 2=20 points

Reverse=20 points

Skip=20 points

Wild=50 points

Wild Draw 4=50 points

The winner is the first player to reach 500 points. However, the game may be scored by keeping a running total of points that each player has left at the end of each hand. When one player reaches 500 points, the player with the lowest points is the winner.

The worth of these prior art games is derived primarily from their entertainment value. Moreover, these games are limited to traditional or specialized decks of cards, which do not lend themselves to the promotional aspects of this invention. Thus, in addition to providing entertainment, the present invention offers the advantage of serving as a promotional tool.

SUMMARY

The objective of the card game is to accumulate points by matching three sets of cards and by laying matching cards against other players' three-card matches until a player runs out of cards. When a player runs out of cards, the round ends. At that point, the players score the round.

The deck of cards of the present invention includes 15 distinct 3-card sets of cards with matching indicia and 7 wild cards with matching indicia. The indicia on both the 3-card sets and wild cards might serve educational or promotional purposes. However, unlike standard decks of cards, which in some instances might contain promotional or advertising material, the promotional indicia on the cards of this invention are on the front or face of the cards instead of the back. The game is played with this deck of cards.

Scoring is accomplished by counting the three-card matches for each player. A player is awarded 30 points for each three-card match that utilizes no wild cards and 25 points for each three-card match that utilizes a wild card to complete the match. A player is awarded 10 points for each card played against the matching cards of another player.

The player to reach 700 points first is the winner. To accumulate this number of points, several rounds of the card game will have to be played. However, the players can elect to modify how a game is won. For example, to play a short game, players need not keep score. Each round can be won by the first player to run out of cards or by tallying each player's score after a round. The players can also adjust the maximum score to 300, 500, or another number of total points if time does not allow for a full game.

To begin play, the cards are shuffled and six cards are dealt to each player. The remainder of the deck is placed in the center of the players and the dealer turns one card face up beside the deck. This is the discard pile.

The youngest player initiates the round, although the players may select any player for this purpose, including the player who won the first or a previous round. The first player has a choice of picking up the card from the discard pile or drawing from the deck. The discard pile in this game is unique in that the player can only pick up a card from the discard pile if that card makes a 3 card match in the player's hand, either by combining two matching cards with a wild card, or combining all three matching cards. A player is not allowed to pick up a card from the discard pile unless a three-card match is accomplished. As each player continues to play the round, the choice is to draw from the deck or choose a card from the discard pile. As players discard, the discard pile should spread out face up so that players are able to see all the cards in the discard pile as shown below.

At each player's turn, a choice is made to draw from the deck or utilize cards in the discard pile. The player may take all or part of the discard pile at that player's appropriate turn. For example, if a player sees a card halfway into the discard pile that will benefit the player's hand and make a three-card match, the player takes that card, along with all the cards more recently played on the discard pile. If the bottom card of the discard pile is the choice of the player to give a match, that player must take the bottom card along with the remaining cards and play continues after the player discards. In this last example, the discard pile would start over again with only one card.

Play continues by each player, in a clockwise motion, picking up cards and discarding cards while laying down matches of three cards (or two cards plus a wild card), to gain points.

When a player lays down the last of his cards, he must say, "En Fuego" (meaning on fire in Spanish) or another agreed upon signal term. The other player or players are penalized 10 points for each card left in their hand that is not a wild card.

In the drawings, which are not necessarily drawn to scale, like numerals describe substantially similar components throughout the several views. Like numerals having different letter suffixes represent different instances of substantially similar components. The drawings illustrate generally, by way of example, but not by way of limitation, various embodiments discussed in the present document.

BRIEF DESCRIPTION OF THE DRAWINGS

In the drawings, wherein like reference numerals and letters indicate corresponding structure throughout the several views.

PREFERRED EMBODIMENTS OF THE PRESENT INVENTION

In the following detailed description, reference is made to the accompanying drawings that form a part hereof, and in which is shown by way of illustration, specific embodiments or examples. These embodiments may be combined, other embodiments may be utilized, and structural and logical changes may be made without departing from the spirit and scope of the present invention. The following detailed description is, therefore, not to be taken in a limiting sense, and the scope of the present invention is defined by the appended claims and their equivalents.

The present cards and method are described with respect to a matching card game. The player to reach 700 points first is the winner. Points are accumulated by matching sets of three cards and/or winning each round by running out of cards. Players receive points for sets of three matches, playing off opponents' matches and running out of cards first in the round. Negative scoring is counted by the number of cards left in the opponents' hands once a player is out of cards.

Figure 1:
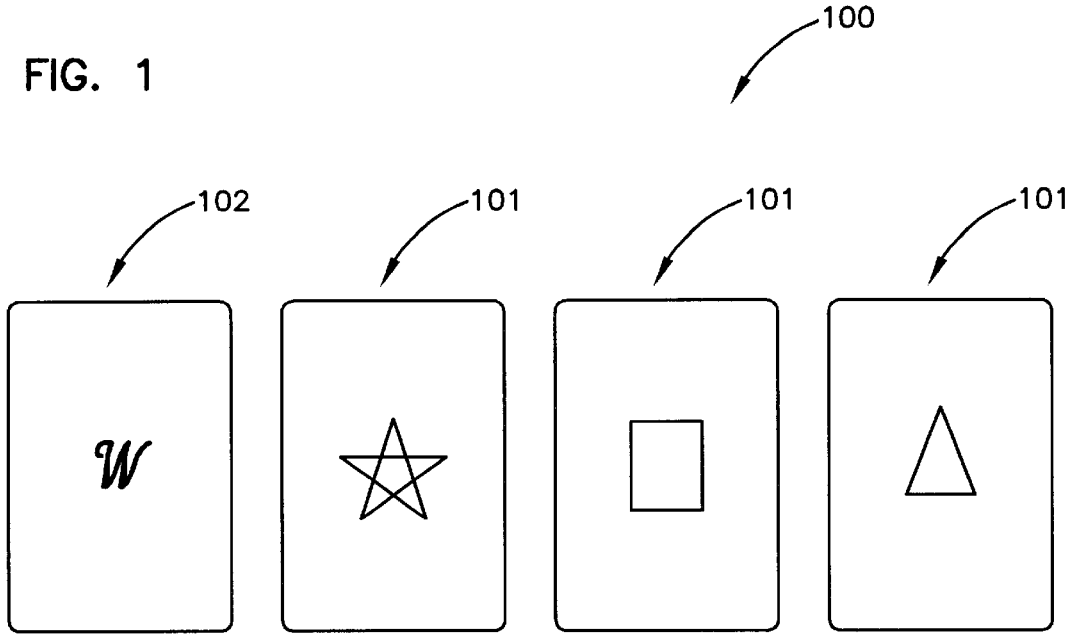
FIG. 1 is a diagram illustrating, generally, among other things, an embodiment of the cards of the present invention.
Figure 3:
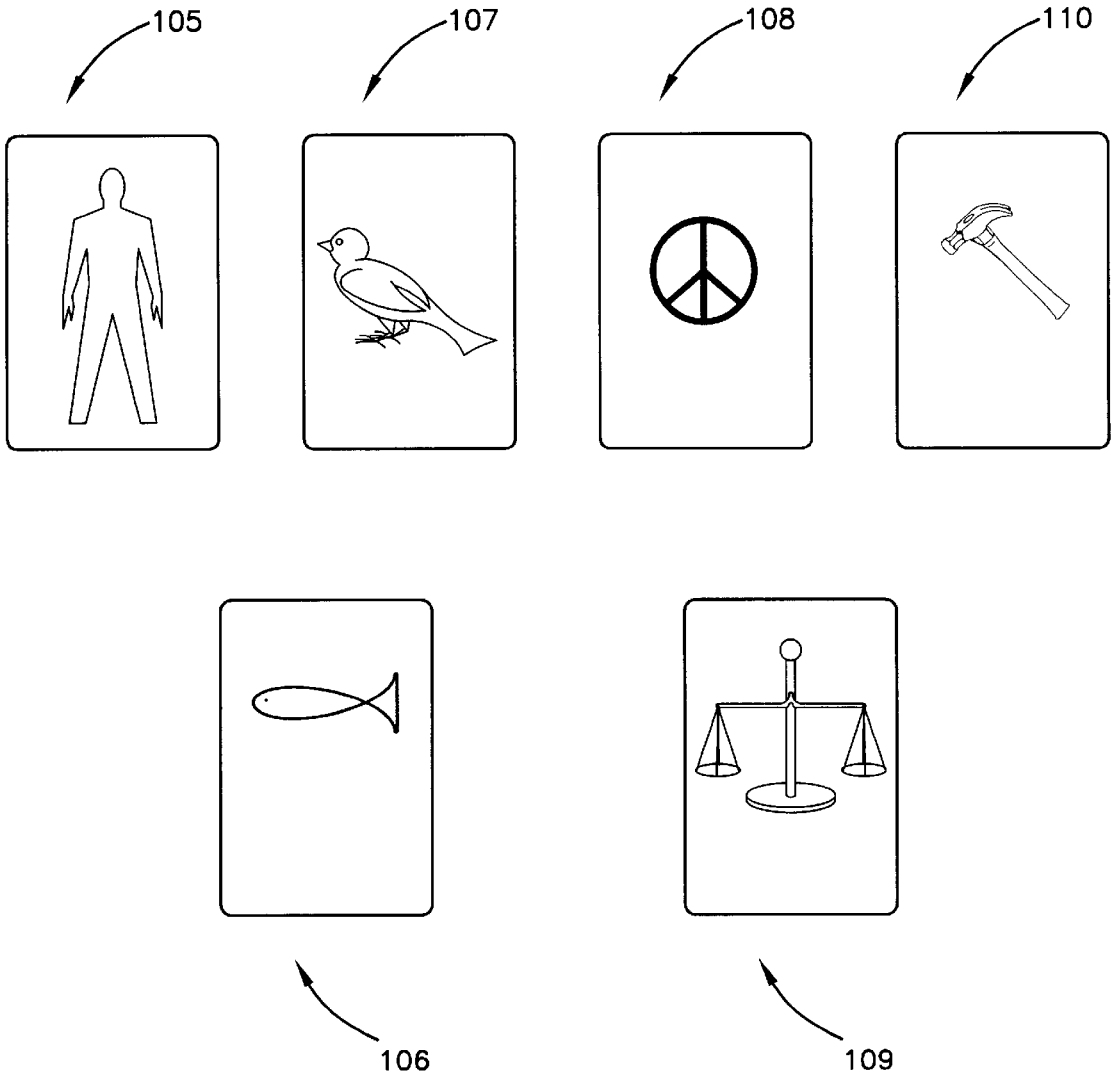
FIG. 3 is a diagram illustrating, generally, among other things, other embodiments of the cards of the present invention.

In a preferred embodiment, the game is played with a deck of 52 cards: 7 free (or wild) cards and 15 sets of 3 matching cards. FIG. 1 shows a set of cards 100 with different matching indicia. In this embodiment, the indicia 101 are geometric symbols. FIG. 1 also shows the wild card 102 as having a "W" to distinguish it from the sets of the matching cards. Those of skill in the art will appreciate that the matching indicia can be any visually discernible image as shown in FIG. 3. By way of a non-limiting example only, the indicia may be people 105, animals 106, birds 107 or other tangible objects. The indicia might also include, by way of a non-limiting example only, intangible concepts, like ideas 108 or services 109. By utilizing more sophisticated matching indicia, the game may also serve as an educational, training or marketing tool. For example, in one embodiment of the invention, the matching indicia 110 may be the product line of a company that sells tools. The present invention provides the advantage of providing additional education, training or marketing on the back of the cards. Moreover, the players can constantly view the educational, training or marketing indicia on the fronts of the cards in the discard pile and in their hands.

The youngest player in the game starts the first game; and the winner of the first game starts the following game or games. However, the players may decide to allow someone other than the youngest player to begin the first game.

Figure 2:
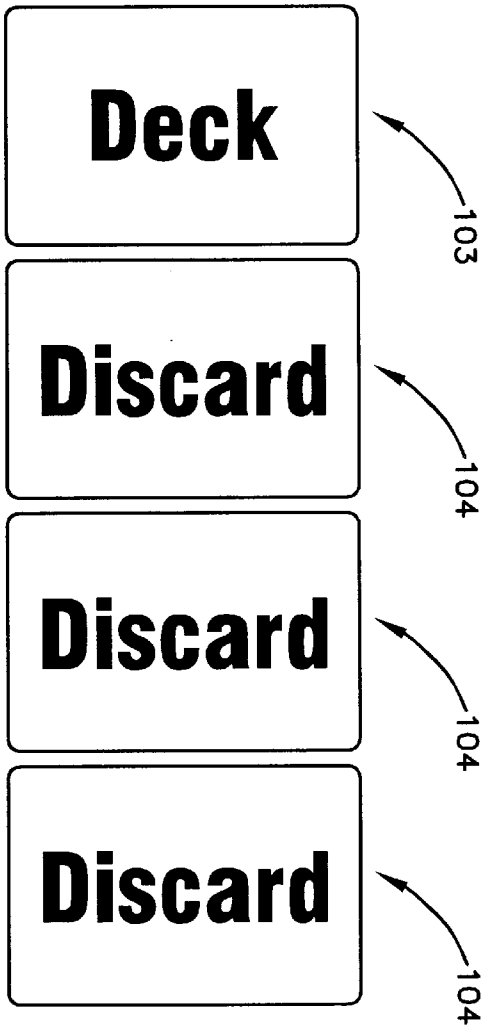
FIG. 2 is a diagram illustrating, generally, among other things, the deck and the discard pile.

After the deck is shuffled, the dealer deals out six cards to each player and the remainder of the deck is placed in the center of the players and the dealer turns one card face up beside the deck. This is known as the discard pile. FIG. 2 shows the deck 103 and discard pile 104. Players should organize their cards so the matching cards are together. Once it is decided who starts, a clockwise rotation of players follows.

The first player has a choice of picking up the card from the discard pile 104 or drawing from the deck 103. The discard pile 104 in this game is unique in that the player can only pick up a card from the discard pile 104 if that card makes a 3 card match in the player's hand, either by combining two matching cards with a wild-card 102, or combining all three matching cards. A player is not allowed to pick up a card from the discard pile 104 unless a three-card match is accomplished. As each player continues to play the round, the choice is to draw from the deck 103 or choose a card from the discard pile 104. As players discard, the discard pile 104 should spread out so that players are able to see all the cards in the discard pile 104.

At each player's turn, a choice is made to draw from the deck 103 or utilize cards in the discard pile 104. If a player sees a card halfway into the discard pile 104 that will benefit the player's hand and make a three-card match, the player takes that card, along with all the cards more recently played on the discard pile 104. If the bottom card of the discard pile 104 is the choice of the player to give a match, that player must take the bottom card along with the remaining cards and play continues after the player discards. In this example, the discard pile 104 would start over again with only one card. If any player goes out and one player has several cards remaining after picking up the discard pile 104, each one of the cards will count 10 points against that player's score.

Players must monitor the discard pile. If three matching cards appear in the discard pile 104, the player who laid down the third card must pick up the entire pile, not just the portion containing the three matching cards.

Play continues by each player, in a clockwise rotation, picking up cards and discarding cards while laying down matches of three cards (or two cards plus a wild card 102), to gain points. Each group of cards making a match laid down is worth 10 points per match card (for a total of 30 points) or 25 points if a wild card 102 is used. If a player uses two cards and a wild card 102 and an opponent draws or has the other matching card, that card can also be laid down and is worth 10 points for the player laying that card down. When a player lays down the last of his cards, he must announce that to the other players. By way of a non-limiting example only, that announcement would take the form of the word "En Fuego," which the player would shout after laying down his last card. The other player or players are penalized 10 points for each card left in their hands that is not a wild card 102.

Scoring begins when one player runs out of cards and the round is completed. At the end of the round all of the matches are counted (30 points per match with no wild cards and 25 points per match with a wild card) for each player. Ten points are allowed for each card played against the matching cards of another player.

The following is an example of how a game might be scored after player 1 runs out of cards. In this example, player 1 has made five matches of three cards each. Three of the matches do not utilize a wild card 102 (90 points) and two matches utilize a wild card 102 (50 points). Therefore, player 1's score at the end of the round would be 140 points. Player 2 has three matches down and two single cards down to use against the matches of player 1. Player 2 utilized no wild cards 102. Therefore, player 2 gets 30 points for each match (for a total of 90 points) plus 10 points for each card played against player one's matches (total of 20 points), for a total of 110 points. Player 2 also had five cards remaining in his hand when player 1 ran out and therefore at 10 points each, 50 points are subtracted from his score, giving player 2 a net total of 60 points. At the end of the round the scores are written down, the cards re-shuffled and play begins anew with six cards being dealt to each player. Play continues until one player reaches 700 points.

To play a short game, players need not keep score. Each round can be won when a player is out of cards or by counting points. The maximum score can also be adjusted to 300 or 500 points if time does not allow for a full game. If, during one round, the entire deck 103 is gone through, the discard pile 104 is then turned over and it becomes the deck 103.

It is to be understood that the above description is intended to be illustrative, and not restrictive. For example, the above-described embodiments may be used in combination with each other. Many other embodiments will be apparent to those of skill in the art upon reviewing the above description. The scope of the invention should, therefore, be determined with reference to the appended claims, along with the full scope of equivalents to which such claims are entitled. In the appended claims, the terms "including" and "in which" are used as the plain-English equivalents of the respective terms "comprising" and "wherein."

What is claimed is:

1. A method of playing a card game for play by at least 2 players in which players match sets of a plurality of cards in a card deck, the method comprising the steps of:

a. shuffling the card deck;

b. dealing at least six cards of the card deck to the players;

c. placing a remainder of the card deck in the center of the players and turning one card in the remainder of the card deck face-up beside the remainder of the card deck to reveal its indicia, said face-up card being a first card of a discard pile;

d. determining an order of play of a round by identifying a youngest player in a game or a winner of a previous round, said youngest player or winner playing first and play continuing in a clockwise rotation;

e. wherein players take a turn, each turn comprising:

i. drawing a card and all cards discarded after that card in the discard pile if the card makes a three-card match in the player's hand by combining two cards with matching indicia with a wild card or combining three cards with matching indicia, or ii. drawing all cards in the discard pile if the player discards a card that makes a three-card match with two other cards already in the discard pile, or iii. drawing a card from the remainder of the card deck;

iv. combining two cards with matching indicia with a wild card or combining three cards with matching indicia;

v. laying down two cards with matching indicia with a wild card or three cards with matching indicia, said laid match representing to the player laying down the matching cards 10 points for each card for a total of 30 points or 25 points total if a wild card is used to make the match;

vi. playing against a match by laying down a matching card on a three-card match made by another player in which the other player used a wild card to make the match, said matching lay representing 10 points to the player laying down the card;

vii. discarding a card from the player's hand face-up, said face-up card being a next card in the discard pile;

f. converting the discard pile into the card deck should the players exhaust the remainder of the card deck before a player runs out of cards;

g. playing a round until a player runs out of cards, at which point the player announces to the other player or players that player has won a round by running out of cards; and h. declaring a winner of the game, wherein:

i. declaring the winner of the game as being the player to win a round by first running out of cards, or ii. declaring the winner of the game by tallying the points that each player earned for laying down three-card matches and for playing against the matches of other players, and subtracting 10 points for each card not a wild card that remains in the other player's or players' hand from that player's total points, or iii. declaring the winner of the game as being the player to first reach a predetermined number of points after the round or continuing a next round of the game until a player reaches a predetermined number of points, or iv. declaring the winner of the game as being the player with the most points should more than one player reach a predetermined number of points after a round.

2. The method of claim 1, comprising the further step of declaring a winner when a predetermined number of points are reached.

3. The method of claim 2, wherein the predetermined number of points is selected from the group consisting of 300, 500 or 700 points.

4. The method of claim 2, wherein the players decide the number of points necessary to win a game.

5. The method of claim 1, comprising the further step of declaring a winner of the game, wherein the winner of the game is the player to win the round by first running out of cards.

6. The method of claim 1, comprising the further step of declaring a winner of the game, wherein the points that each player has earned for laying down 3-card matches and for playing against the matches of other players, and subtracting 10 points for each card not a wild card that remains in the other player's or players' hand from that player's total points are tallied, and wherein a winner of the game is declared as the player to first reach a predetermined number of points after the round, wherein if the predetermined number of points is not reached, continuing a next round of the game until a player reaches a predetermined number of points.

7. The method of claim 6, comprising the further step of declaring a winner of the game as being the player with the most points should more than one player reach a predetermined number of points after a round.

8. The method of claim 1, wherein the deck comprises cards having a plurality of promotional indicia on the faces of the cards.

9. The method of claim 1, wherein the card deck comprises 15 sets of 3 cards and 7 wild cards.

10. The method of claim 1, wherein the card deck comprises at least 15 sets of cards of matching indicia on a face of each card and at least 7 wild cards of matching indicia on a face of each card.

11. The card deck of claim 10, wherein the sets of cards and wild cards with matching indicia comprise tangible objects.

12. The card deck of claim 10, wherein the sets of cards and wild cards with matching indicia comprise different animal species.

13. The card deck of claim 10, wherein the sets of cards and wild cards with matching indicia comprise concepts.

14. The card deck of claim 10, wherein the sets of cards and wild cards with matching indicia comprise a set of a company's line of products.

15. The card deck of claim 10, wherein the card deck comprises at least 15 sets of three cards of matching indicia on a face of each card and at least 7 wild cards of matching indicia on a face of each card.

16. The card deck of claim 10, wherein the indicia on the faces of the cards comprise educational or promotional images.

17. The card deck of claim 12, wherein the different animal species comprise different bird species.

* * * * *